US005829994A

United States Patent [19]

Oda et al.

[11] Patent Number: 5,829,994

[45] Date of Patent: Nov. 3, 1998

[54] LEVER-TYPE CONNECTOR

[75] Inventors: Kenzo Oda, Hadano; Hiroshi Kitamura, Kanagawa, both of Japan

[73] Assignee: The Whitaker Corporation, Wilm., Del.

[21] Appl. No.: 789,506

[22] Filed: Jan. 27, 1997

[30] Foreign Application Priority Data

Jan. 26, 1996 [JP] Japan ..... 8-032969

[51] Int. Cl.[6] ..... H01R 13/62

[52] U.S. Cl. ..... 439/157; 439/310; 439/372

[58] Field of Search ..... 439/157, 160, 439/310, 372

[56] References Cited

U.S. PATENT DOCUMENTS 5,010,426 4/1991 Krenz ..... 439/157
5,110,301 5/1992 Inoue et al. ..... 439/157
5,564,935 10/1996 Yagi et al. ..... 439/157
5,641,296 6/1997 Larabell et al. ..... 439/157

*Primary Examiner*—Hien Vu
*Attorney, Agent, or Firm*—Bradley N. Ditty

[57] ABSTRACT

The present invention is directed to a compact lever-type connector in which a lever can be fixed in specified positions. Lever (50) is installed on a side surface (24) of a housing (18) so that the lever (50) is free to pivot. The lever (50) has a lever main body (56) and an extensible lever (58) which is attached to the lever main body (56) so that the extensible lever (58) can be extended and retracted. Respective grooves (80), (82) and (84) are formed in the lever main body (56) and extensible lever (58). An arcuate rib (90) is formed on the housing (18). Only when the extensible lever (58) is extended are the grooves (80) (82) and (84) aligned so that the rib (90) can be accommodated by these grooves, thus allowing pivoting of the lever (50). In the initial and final positions of the lever (50), the extensible lever (58) can be extended and retracting relative to the lever main body (56).

6 Claims, 4 Drawing Sheets

LEVER-TYPE CONNECTOR

FIELD OF USE

The present invention relates to an electrical connector, and specifically relates to a lever-type connector which is constructed so that the lever can be extended and retracted.

BACKGROUND OF THE INVENTION

In electrical connectors, the operating force required in order to connect or disconnect connectors increases with an increase in the number of electrical terminals to be electrically connected, i.e., with an increase in the number of terminals. Accordingly, it becomes difficult to connect or disconnect connectors merely by pushing the connectors together and pulling the connectors apart. Various systems have been conceived in order to solve this problem. For example, mechanisms equipped with a pivoting lever, and mechanisms which use a cam slide, and which achieve a low insertion/pull-out force by the engagement of a cam groove and a cam follower, are known. Furthermore, lever-type mechanisms are designed so that the length of the lever can be extended in order to achieve a considerable reduction in the operating force required.

One example of such a mechanism is the lever-type connector 200 disclosed in Japanese Patent Publication No. 7-220805, as shown in FIG. 4. The lever 214 of this connector 200 has a lever main body 212 and an extensible lever 213. A roughly Z-shaped guide projection 221 is formed on the housing 211 of the connector 200. An inward-facing projection (not shown) formed on the extensible lever 213 passes through a slot 236 in the lever main body 212, and is guided by the guide surface 221*a* of the guide projections 221 during the pivoting process of the lever 213. At the position where pivoting of the lever 214 is initiated, the lever 214 is in an extended state, and the lever 214 can be pushed inward at the position where pivoting of the lever 214 is completed. When the lever 214 is pushed inward, the projection on the extensible lever 213 is guided by a second guide surface 221*b* of the guide projection 221; furthermore, a third guide surface 221*c* is formed on the guide projection 221 in order to prevent further rotation.

In the lever-type connector described above, the lever is not held in a specified position in an initial state prior to pivoting of the lever. As a result, the lever is easily caused to pivot if an external force is applied to the lever during shipping or prior to assembly. Accordingly, the lever must be returned to its original position at the time of engagement, thus creating extra work. Furthermore, in cases where the connector is installed in an automobile or the like, the connector cannot pass through specified holes in the vehicle body panels if the lever protrudes in the initial state, as it does in conventional connectors.

Moreover, it is difficult to maintain the length of the lever at a fixed length during pivoting of the lever, and dimensional precision is required for smooth operation of the lever.

Furthermore, an additional guide surface is necessary in order to prevent the return of the lever when the lever is in a final position; accordingly, the structure of the connector is complicated.

Thus, a feature of the present invention is to provide a lever-type connector with a simple structure which makes it possible to hold the lever in an initial position, guide the lever during pivoting, and hold the lever in position when pivoting is completed.

Furthermore, another feature of the present invention is to provide a compact lever-type connector which minimizes the amount of protrusion of the lever prior to engagement and after engagement.

SUMMARY OF THE INVENTION

A lever-type connector of the present invention comprises a housing equipped with a pivoting lever that effects the mutual connection and disconnection of connectors, wherein the lever has a lever main body and extensible levers which are disposed on the lever main body so that the extensible levers can be extended and retracted, arcuate ribs which extend in the direction of pivoting of the lever between the position of pivoting initiation and the position of pivoting completion of the lever are formed on the housing, and grooves, which are aligned with the arcuate ribs and which receive the ribs only when the extensible levers are in an extended position, are formed in the extensible levers, so that the levers can be pushed in at the position of pivoting initiation and at the position of pivoting completion.

A lever-type electrical connector for connection with and disconnection from a mating electrical connector, which comprises a housing having a pivoting lever mounted thereon for effecting connection and disconnection of the connectors, the pivoting lever including a main body and an extensible lever mounted on the main body so that the extensible lever can be extended and retracted; and guide members provided on the housing and the extensible lever enabling the extensible lever to be moved to a retracted position only when the extensible lever is at an extended position and when the pivoting lever is at a position of pivoting initiation and a position of pivoting completion.

BRIEF DESCRIPTION OF THE DRAWINGS

The present invention will now be described by way of example with reference to the accompanying drawings in which.

DETAILED DESCRIPTION OF THE INVENTION

Figure 1:
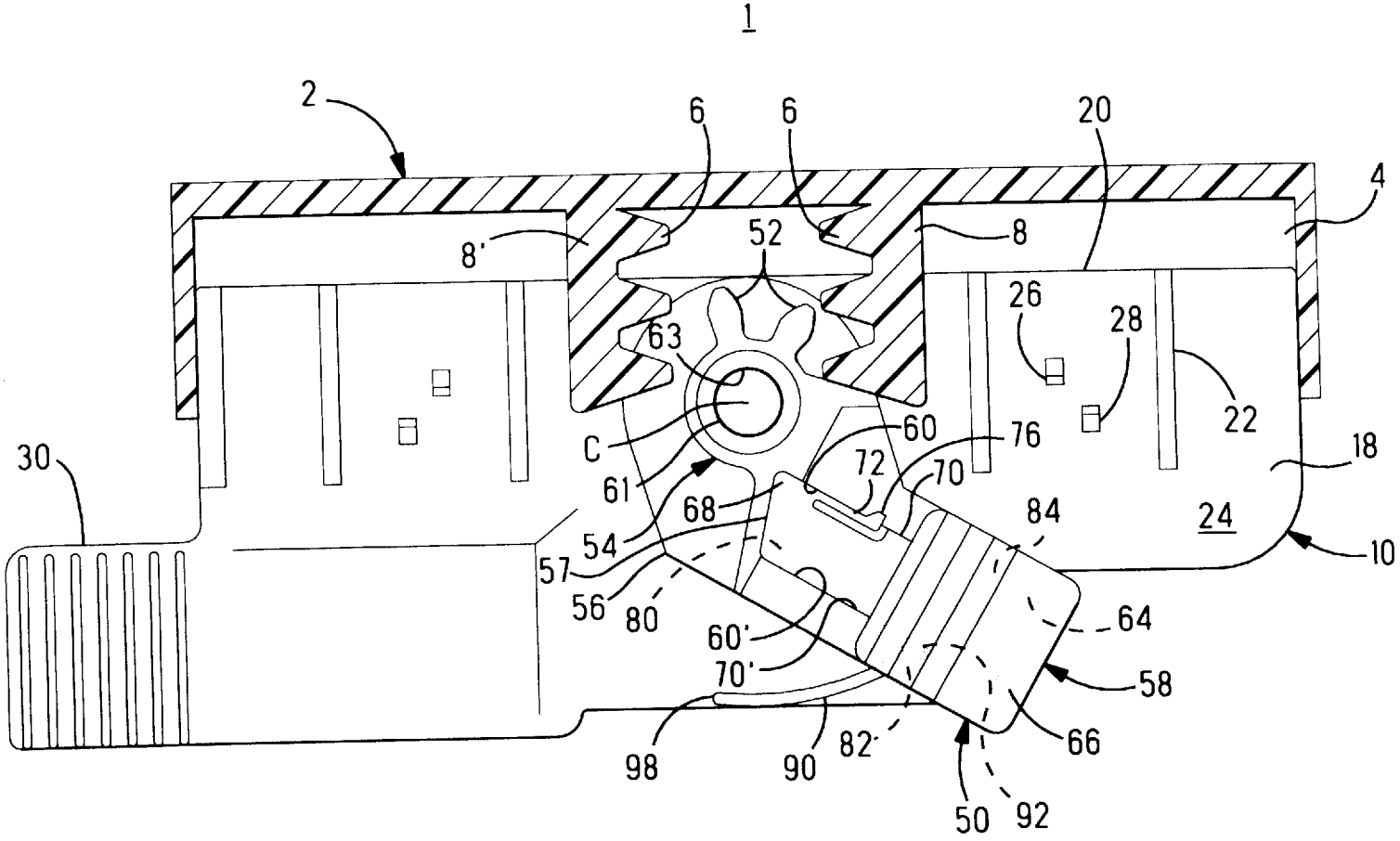
FIG. 1 is a part cross-sectional plan view of a lever-type connector of the present invention.

FIG. 1 is a part cross-sectional plan view of a lever-type connector 1 of the present invention. Female connector 2 has a substantially rectangular shape, and receives male connector 10 in a recess 4 thereof. A pair of racks 8, 8' which have a plurality of teeth 6 are formed facing each other as integral parts of the female connector 2 in the approximate center of the female connector. Racks 8, 8' are also formed facing the opposite side so that the female connector 2 has a total of two pairs of racks. A lever 50 on which a pinion 54 which has teeth 52 formed thereon is installed on the male connector 10 so that lever 50 is free to pivot. When the lever 50 is caused to pivot, the teeth of the racks 8, 8' and the teeth 52 of the pinion 54 engage. The lever 50 is shaft-supported at the approximate center C of the housing 18 of the male connector 10 with respect to the direction of the length of the housing 18.

A plurality of ribs 22 which extend rearward from the engagement surface 20 of the housing 18 of the male connector 10 are formed on the housing 18. These ribs 22 act in conjunction with corresponding grooves (not shown) formed in the female connector 2 so that the male connector 10 is guided during insertion and removal. Respective temporary anchoring projections 26 and full anchoring projections 28 are formed at two places each on the side surface 24 of the male connector 10 and in symmetrical positions which are roughly equidistant from the supporting point of the lever 50 in the direction of the length of the housing 18. Such projections 26, 28 are also similarly formed on the opposite side surface (not shown) of the male connector 10. These projections 26, 28 respectively engage with recesses (not shown) formed in the female connector 2 during temporary latching of the connectors and when engagement of the connectors is completed, so that the connectors are held in place. Furthermore, male connector 10 includes a wire lead-out member 30, which gathers and leads out the electrical wires from male connector 10.

The lever 50 has a lever main body 56 with a roughly C-shaped form which straddles the housing 18, and an extensible lever 58 which is attached so that the respective side edges 60, 60', 70, 70' are in a tongue and groove relationship, thus allowing the extensible lever 58 to slide with respect to the lever main body 56. The extensible lever 58 is integrally linked to an extensible lever (not shown) on the opposite side of the male connector 10. Since the lever 50 has a symmetrical shape, only one side of the lever 50 will be described below. The lever 50 is formed from a resin such as a plastic or the like, and the pinion 54 is formed as an integral part of the housing 18. The shaft-supporting part is a post 61 which projects from the housing 18. Post 61 is inserted into a post-receiving hole 63 formed in the lever main body 56. It would also be possible to form the post on the lever main body 56, and to form a hole which receives the post in the housing 18.

An opening 57, which extends in an axial direction of the lever main body 56, is formed in the lever main body 56. Indentations 62 and 64 are formed at two places which are separated from each other in the axial direction of the lever main body 56 in the side edge 60 of the opening 57. The extensible lever 58 has a knob part 66 and a sliding part 68 which is accommodated inside the opening 57, and which slides relative thereto. The sliding part 68 has a latch arm 72 on the side edge 70. Latch arm 72 is formed so that it extends in the sliding direction of the sliding part 68 via a slot 74 formed in the side edge 70. Furthermore, the tip of the latch arm 72 has a projection 76. In the state prior to pivoting, i.e., in the retracted state (shown in FIG. 1), the sliding part 68 of the extensible lever 58 is accommodated inside the opening 57, and the projection 76 of the latch arm 72 is engaged with the indentation 62 of the opening 57, so that the position of the extensible lever is fixed. A point to be noted here is that an arcuate groove 80 extending along a circle centered on the center of pivot C is formed in the tip portion of the sliding part 68, in the surface facing the housing 18. Furthermore, similar arcuate grooves 82 and 84 are also formed in the lever main body 56 on both sides of the opening 57. These grooves 80, 82 and 84 may also be rectilinear grooves, but are preferably arcuate grooves.

A rib 90, which forms a portion of a circle centered on the center of pivot C, is formed on the side surface 24 of the housing 18. In the state prior to the pivoting of the lever 50 (shown in FIG. 1), one end 92 of the rib 90 is inserted into the groove 82 of the lever main body 56, and is in contact with the side edge 70' of the sliding part 68. As a result, the lever 50 cannot be caused to pivot in the clockwise direction in FIG. 1. Accordingly, even if an external force should act on the knob part 66, the lever 50 continues to maintain this position.

Figure 2:
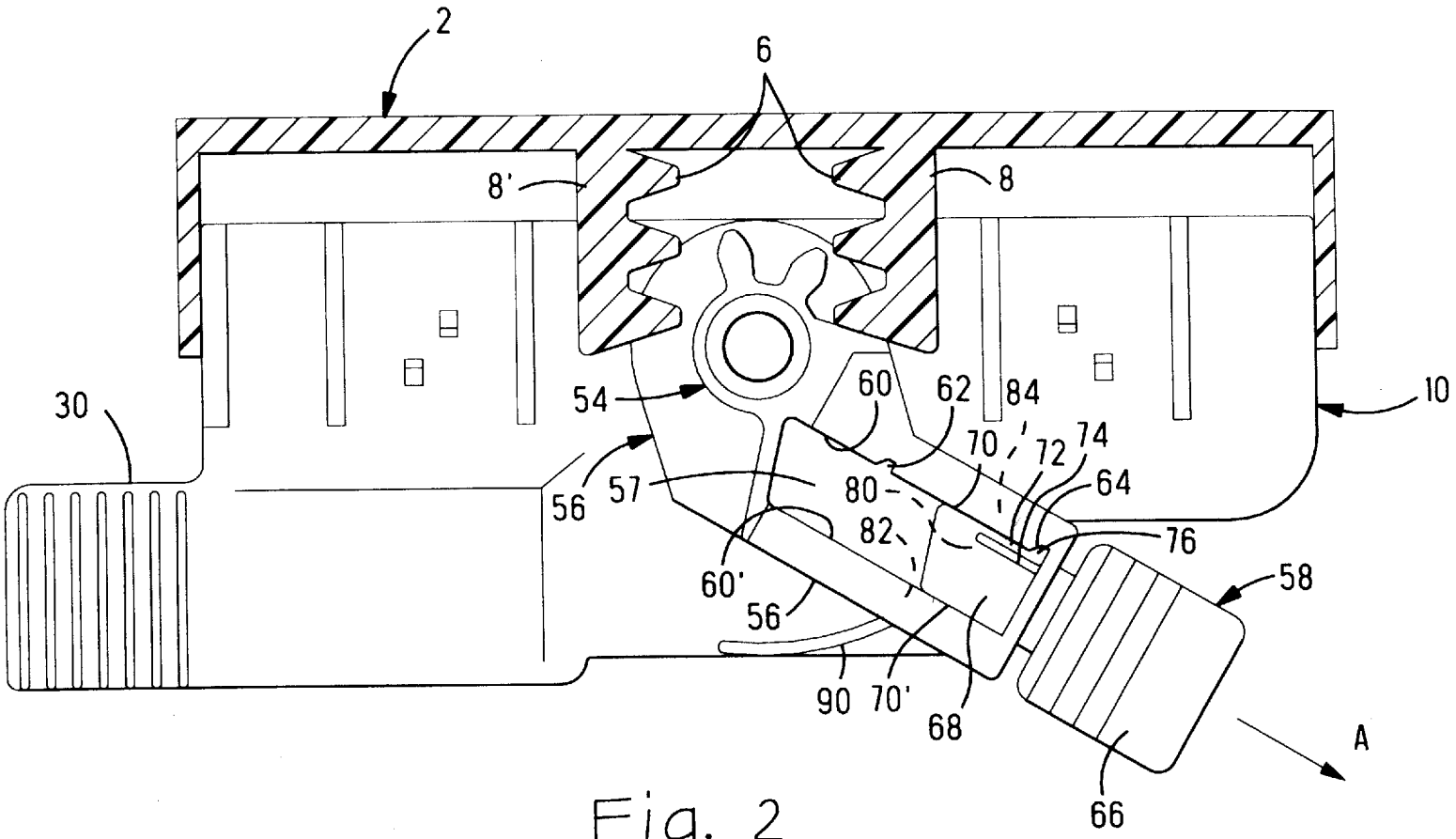
FIG. 2 is similar to FIG. 1, illustrating a state in which the extensible levers of the lever-type connector in FIG. 1 are pulled out.

Next, in the case where the extensible lever 58 is extended as shown in FIG. 2, the engagement between the latch arm 72 and the indentation 62 is released when the knob part 66 is pulled, so that the sliding part 68 moves outward as indicated by arrow A and the projection 76 engages with the indentation 64, thus causing the extensible lever 58 to be fixed in the extended position. Here, the respective side edges of the opening 57 and sliding part 68 are designed as follows: i.e., ribs (not shown) which extend in the direction of length of the sliding part 68 are formed in the side edges 70, 70' of the sliding part 68, and these ribs are accommodated in recessed grooves (not shown) formed in the side edges 60, 60' of the opening 57. Accordingly, the sliding part 68 slides while being guided and prevented from falling out of the opening 57.

In the position shown in FIG. 2, in which the extensible lever 58 is pulled out, the grooves 80, 82 and 84 are aligned, and can accommodate the rib 90. Accordingly, when the lever 50 shown in FIG. 2 is caused to pivot in the clockwise direction, the rib 90 is accommodated in the grooves 80, 82 and 84, so that the rack 8 and the teeth 52 of pinion 54 begin to engage. During the pivoting of the extensible lever 58, the pivoting of the lever 50 is guided by the rib 90 and aligned grooves 80, 82, 84 and the movement of the extensible lever 58 in the direction of length is checked by the engagement of the projection 76 of the latch arm 72 with the indentation 64, so that the connector can be operated in a stable state.

Figure 3:
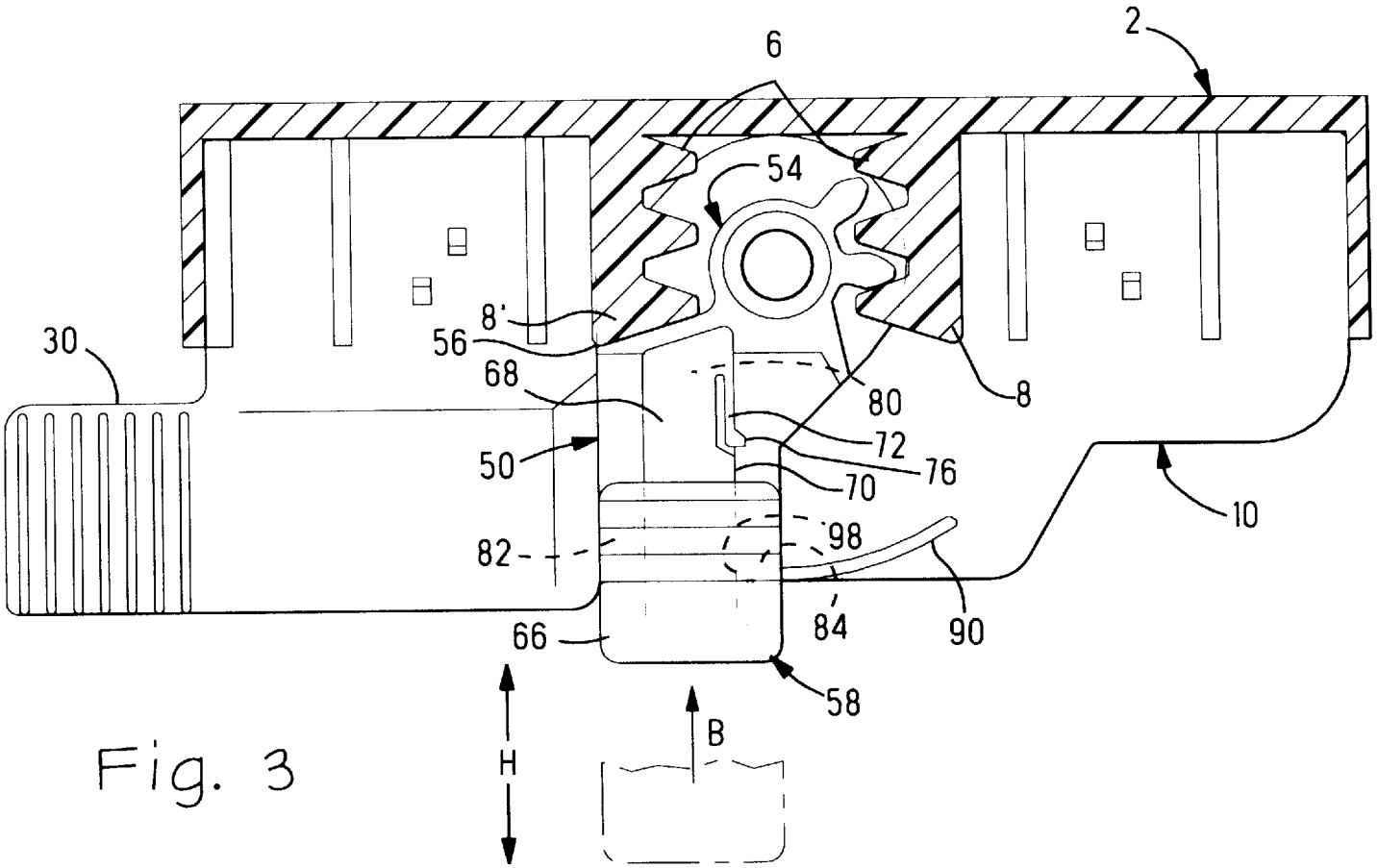
FIG. 3 is similar to FIG. 1, illustrating a state in which the lever-type connector shown in FIG. 1 has been completely engaged, and the extensible levers have been pushed in to a final position.
Figure 4:
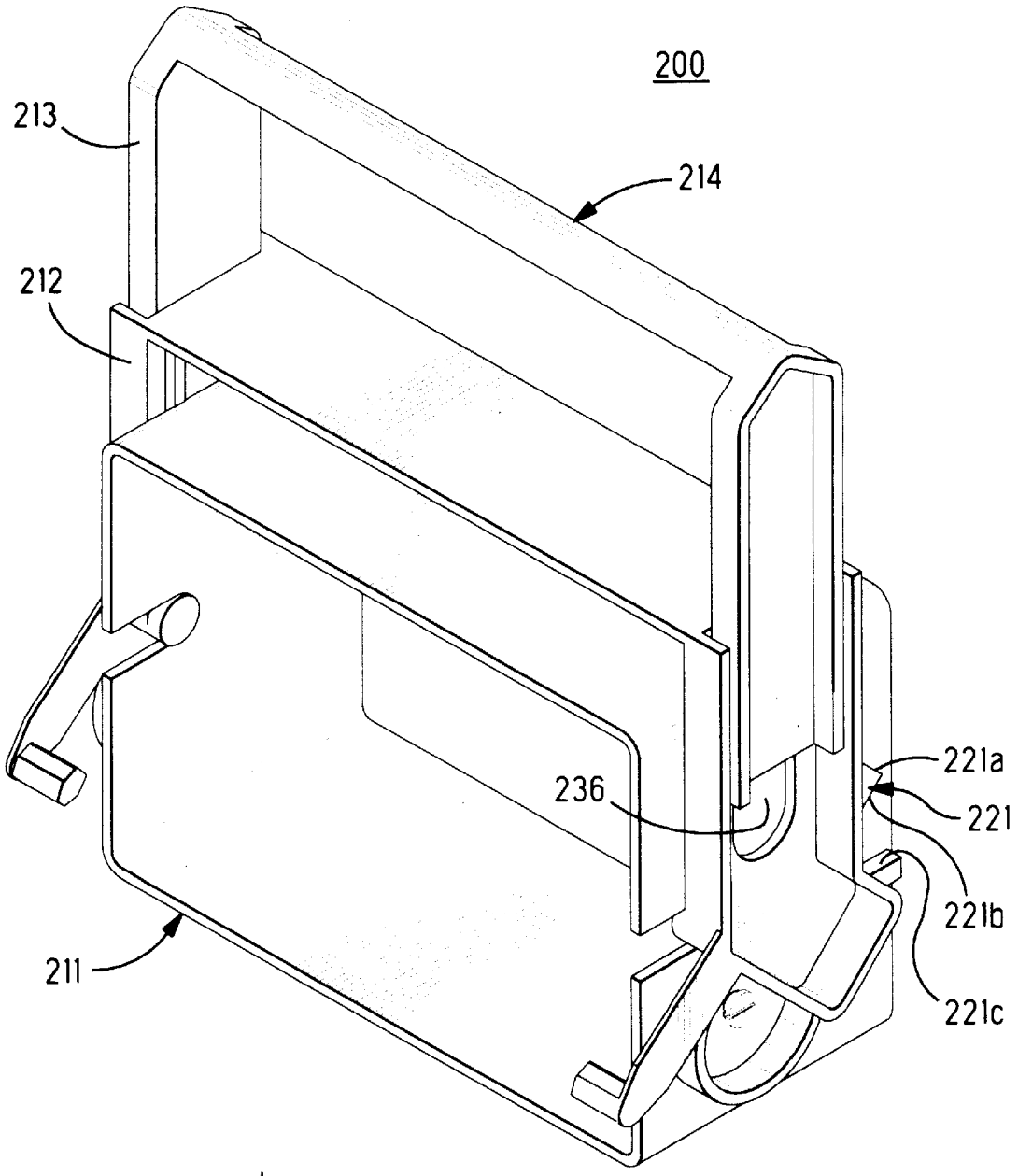
Fig. 4 (Prior Art)
FIG. 4 is a perspective view showing a conventional lever-type connector.

Next, the state in which the operation of the lever 50 has been completed will be described with reference to FIG. 3. Specifically, when the lever 50 is caused to pivot in the clockwise direction so that the female connector 2 and male connector 10 are completely engaged, the engagement of the sliding part 68 of the extensible lever 58 with the rib 90 is released at the other end 98 of the rib 90, so that the extensible lever 58 can be pushed inward, i.e., in the direction of retraction of the extensible lever 58 (as indicated by arrow B). The connector 1 shown in FIG. 3 is in a state in which the extensible lever 58 has been pushed in. When the extensible lever 58 is pushed in, the side edge 70 of the sliding part 68 contacts the other end 98 of the rib 90, so that the lever 50 is prevented from returning in the counterclockwise direction. Accordingly, the connector 1 is maintained in an engaged or connected state. Furthermore, as a result of the knob part 66 being pushed in, the dimension of the connector 1 in the direction perpendicular to the direction of length of the connector 1 is reduced by an amount corresponding to the amount H by which the knob part 66 is pushed in.

Here, the reason that the racks 8, 8' are installed facing each other in the direction of length is to allow engagement with the female connector 2 even when the male connector 10 is reversed with respect to the direction of length. As a result, requirements for different wire lead-out directions can be satisfied by reversing the orientation of the wire lead-out part 30 of the male connector 10.

A preferred working configuration of the present invention has been described above. However, the present invention is not limited to this working configuration; it goes without saying that various modifications and alterations are possible. For example, in the above working configuration, an opening 57 was formed in the lever main body 56; however, as long as the extensible lever 58 can slide relative to the lever main body 56, such an opening 57 is not absolutely necessary. Furthermore, in the above working configuration, the teeth 52 of the pinion 54 were positioned on the outside; however, it would also be possible to position these teeth on the inside. Moreover, a spring may be installed on the extensible lever 58 so that the extensible lever 58 is spring-driven in the direction of retraction.

The connector of the present invention has a structure in which arcuate ribs which extend in the direction of pivoting of the lever between the position of pivoting initiation and the position of pivoting completion of the lever are provided, and grooves which are aligned with the arcuate ribs and which receive the ribs only when the extensible levers are in an extended position are also provided, so that the extensible levers can be pushed in at the position of pivoting initiation and at the position of pivoting completion. Accordingly, the connector of the present invention possesses the following merits:

Specifically, since the lever is fixed in the connector in the initial position prior to pivoting, the lever will not move even if subjected to an external force during shipping or handling. Accordingly, there is no need to return the lever to the initial position at the time of connector engagement, and assembly work can therefore be accomplished in an efficient manner.

Movement of the lever in the axial direction during pivoting of the lever is checked, so that the lever can be caused to pivot in a stable manner.

In the final position in which pivoting of the lever is completed, the extensible levers can again be pushed in; accordingly, engagement can be maintained so that the reliability of electrical connections is improved.

Furthermore, since the extensible levers can be pushed in at the initial position and final position, the external dimensions of the connector can be reduced, so that the size of the packaging required for shipping can be reduced, and handling is facilitated. These functions are obtained by means of a simple structure. Furthermore, since the connector is made more compact, design limitations arising from the need to pass the connector through attachment holes in vehicle bodies are also reduced.

We claim:

1. A lever-type electrical connector for connection with and disconnection from a mating electrical connector, said lever-type electrical connector comprising:

a housing having a pivoting lever mounted thereon for pivotal movement relative to said housing, said pivoting lever including a main body and an extensible lever movably attached to said main body so that said extensible lever can be moved to an extended position and a retracted position relative to the main body; and guide members provided in said housing, and complimentary guide members provided in said main body and said extensible lever, said guide members and said complimentary guide members being in alignment when said extensible lever is at said extended position, thereby enabling said pivoting lever to move from a first position of pivoting initiation to a second position of pivoting completion.

2. A lever-type electrical connector as claimed in claim 1, wherein said main body has an opening in which a sliding part of said extensible lever is slidably disposed.

3. A lever-type electrical connector as claimed in claim 2, wherein said opening has inner and outer indentations, said sliding part has a latch arm provided with a projection for engagement with said inner and outer indentations.

4. A lever-type electrical connector as claimed in claim 1, wherein said main body includes a pinion having teeth for engagement with a rack on the mating electrical connector.

5. A lever-type electrical connector as claimed in claim 1, wherein said extensible lever can be moved to said retracted position when said pivoting lever is at said second position.

6. A lever-type electrical connector as claimed in claim 1, wherein said guide members comprise an arcuate rib on said housing extending in a direction of pivoting of said pivoting lever, and arcuate grooves on said main body and said extensible lever, said grooves are aligned when said extensible lever is at said extended position.

* * * * *